US008752633B2

(12) United States Patent
Whitelaw et al.

(10) Patent No.: US 8,752,633 B2
(45) Date of Patent: Jun. 17, 2014

(54) CABLE PROTECTOR

(75) Inventors: Calum Whitelaw, Aberdeen (GB); Alan Craigie, Aberdeen (GB); Andrew Hicks, Aberdeen (GB)

(73) Assignee: Polyoil Limited, Dyce Aberdeen (GB)

( * ) Notice: Subject to any disclaimer, the term of this patent is extended or adjusted under 35 U.S.C. 154(b) by 1206 days.

(21) Appl. No.: 12/601,671

(22) PCT Filed: Jun. 2, 2008

(86) PCT No.: PCT/GB2008/001885

§ 371 (c)(1),
(2), (4) Date: Feb. 2, 2011

(87) PCT Pub. No.: WO2008/149074

PCT Pub. Date: Dec. 11, 2008

(65) Prior Publication Data

US 2011/0174494 A1 Jul. 21, 2011

(30) Foreign Application Priority Data

Jun. 2, 2007 (GB) ..... 0710585.1

(51) Int. Cl.
*E21B 17/10* (2006.01)

(52) U.S. Cl.
USPC ..... 166/364; 166/367; 166/241.6; 138/110

(58) Field of Classification Search
USPC ..... 166/364, 338, 345, 350, 352, 360, 367, 166/380, 241.6, 242.3; 138/110, 155; 405/168.2, 224.2–224.4; 441/133
See application file for complete search history.

(56) References Cited

U.S. PATENT DOCUMENTS

| | | | | | |
|---|---|---|---|---|---|
| 3,410,613 | A | * | 11/1968 | Kuus | 175/325.7 |
| 3,528,499 | A | * | 9/1970 | Collett | 166/175 |
| 3,729,756 | A | * | 5/1973 | Cook et al. | 441/133 |
| 3,741,252 | A | * | 6/1973 | Williams | 138/110 |
| 3,844,345 | A | * | 10/1974 | Evans et al. | 166/72 |
| 4,042,023 | A | * | 8/1977 | Fox | 166/241.7 |
| 4,398,772 | A | * | 8/1983 | Odell | 175/325.6 |
| 4,477,207 | A | * | 10/1984 | Johnson | 405/195.1 |
| 4,484,785 | A | * | 11/1984 | Jackson | 175/325.6 |
| 4,646,840 | A | * | 3/1987 | Bartholomew et al. | 166/350 |
| 5,656,797 | A | * | 8/1997 | Lin | 174/91 |

(Continued)

FOREIGN PATENT DOCUMENTS

| | | | |
|---|---|---|---|
| GB | 2377717 | A | 1/2003 |
| WO | WO 01/25590 | A | 4/2001 |
| WO | WO 2005/090743 | A | 9/2005 |

OTHER PUBLICATIONS

International Preliminary Report on Patentability for Application PCT/GB2008/001885 (Dated Dec. 7, 2009).

*Primary Examiner* — Matthew Buck
(74) *Attorney, Agent, or Firm* — Flaster/Greenberg, P.C.

(57) ABSTRACT

The present invention relates to protector apparatus (30) for protecting at least one cable (24) during operation of a diverter (28). The protector apparatus (30) comprises at least one protector assembly substantially formed of a plastics material. The protector assembly defines a plurality of bores, a first of the plurality of bores being configured to receive a string (23) and a second of the plurality of bores being configured to receive a cable (24). The protector assembly is further configured to define an external surface with which an operating diverter engages when the protector apparatus is in use and a string is received in the first bore.

15 Claims, 6 Drawing Sheets

(56) References Cited

U.S. PATENT DOCUMENTS

| | | | | |
|---|---|---|---|---|
| 5,730,554 | A * | 3/1998 | Mosley et al. | 405/195.1 |
| 5,803,170 | A * | 9/1998 | Garcia-Soule et al. | 166/242.3 |
| 5,973,270 | A * | 10/1999 | Keller | 174/136 |
| 6,270,387 | B1 * | 8/2001 | Nesheim | 441/133 |
| 6,571,878 | B2 * | 6/2003 | Mc Daniel et al. | 166/367 |
| 6,613,982 | B1 * | 9/2003 | Kaland et al. | 174/74 A |
| 6,755,595 | B2 * | 6/2004 | Oram | 405/216 |
| 7,100,641 | B2 * | 9/2006 | Tyrer et al. | 138/110 |
| 7,210,531 | B2 * | 5/2007 | van Belkom | 166/367 |
| 7,214,114 | B2 * | 5/2007 | Gibson | 441/133 |
| 7,383,885 | B2 * | 6/2008 | Bergeron et al. | 166/345 |
| 7,398,697 | B2 * | 7/2008 | Allen et al. | 73/800 |
| 7,467,662 | B2 * | 12/2008 | Smith | 166/343 |
| 7,568,861 | B2 * | 8/2009 | Godoy et al. | 405/211 |
| 7,771,245 | B2 * | 8/2010 | Routeau et al. | 441/133 |
| 7,784,547 | B2 * | 8/2010 | Reddy | 166/360 |
| 2005/0269096 | A1 | 12/2005 | Milberger et al. | |
| 2006/0115335 | A1 * | 6/2006 | Allen et al. | 405/274 |

* cited by examiner

CABLE PROTECTOR

FIELD OF THE INVENTION

The present invention relates to an apparatus and a method for use in dealing with blow outs in oil and gas exploration and completion operations. The present invention also relates to a kit of parts for use, when assembled, in dealing with blow outs in oil and gas exploration and completion operations.

BACKGROUND TO THE INVENTION

In the course of oil and gas exploration and completion operations blow outs occur from time to time. Blow outs present a particular operational hazard in offshore environments. This is because a gas pocket that is present in the marine riser at depth (e.g. on the sea bed) will expand significantly in volume as it rises towards sea level. A means of dealing safely with such a significant volume of gas is needed.

It is known to use a blow out diverter located at or near the rig floor to direct the flow of the gas and drilling fluids away from the rig floor in the event of a blow out. Operation of the diverter normally involves the deployment of a bag or packer, with the bag or packer providing a seal around the landing/running string of sufficient integrity to contain the gas and drilling fluids or at least dissipate the energy of the gas and drilling fluids while they are re-directed by the diverter.

The present inventors have appreciated that the above described approach to dealing with blow outs has shortcomings.

It is therefore an object of the present invention to provide an apparatus and method for use in dealing with blow outs in oil or gas exploration or recovery procedures.

It is a further object to provide an apparatus and method for use with a landing/running string of sub-sea oil or gas exploration or recovery apparatus.

STATEMENT OF INVENTION

The present invention has been devised in view of the shortcomings of known approaches to blow out diversion. Thus, according to a first aspect of the present invention, there is provided protector apparatus for protecting at least one cable during operation of a diverter, the protector apparatus comprising at least one protector assembly substantially formed of a plastics material, the protector assembly defining a plurality of bores, a first of the plurality of bores being configured to receive a string (e.g. a landing/running string) and a second of the plurality of bores being configured to receive a cable, the protector assembly being further configured to define an external surface with which an operating diverter engages when the protector apparatus is in use and a string is received in the first bore.

In use, a string of oil or gas apparatus is received in the first bore of the protector assembly and a cable, e.g. an umbilical, is received in the second bore of the protector assembly. Thus, the protector assembly defines an external surface with which a bag or packer of an operating diverter can engage to form a seal between the packer or bag and the external surface. According to the known approach described above a cable running from the rig to the well-head beside the string may present an obstacle to an adequate seal being formed by the bag or packer around the string. Also, and perhaps more significantly, a deploying bag or diverter used according to the known approach is liable to damage the cable. Forming the protector assembly substantially of a plastics material can provide a protector assembly that is comparatively light and thus readily brought into and removed from use.

More specifically, the at least one protector assembly may be configured to extend, when in use, above and below a diverter.

Alternatively or in addition, the external surface defined by the protector assembly may be curved.

More specifically, the external surface may be substantially cylindrical. More specifically, the external surface may be circularly cylindrical.

Alternatively or in addition, the protector assembly may comprise a first protector component and a second protector component.

More specifically, the first and second protector components may be movable between a first disposition, in which a string may be moved into the first bore, and a second disposition, in which removal of the string from the first bore is resisted. Thus, in the second disposition the first and second protector components may define the first bore between them.

More specifically, the protector apparatus may be configured such that a cable may be moved into the second bore in the first disposition and removal of the cable from the second bore is resisted in the second disposition. Thus, in the second disposition the first and second protector components may define the second bore between them.

Alternatively or in addition, the first and second protector components may be movable bodily in relation to each other. Thus, the protector apparatus may lack hinges between the first and second protector components, thereby reducing the weight of the protector apparatus.

Alternatively or in addition, each of the first and second protector components may define a substantially semi-circular footprint when viewed along the first bore.

Thus, having first and second protector components, which may be substantially formed of a plastics material and which may be no longer than a particular length provides for ease of handling. For example, a user can readily bring each protector component into use and readily remove each protector component from use.

Alternatively or in addition, at least one of the first and second protector components may have a width (i.e. in a direction perpendicular to a longitudinal axis of the first bore) of between about 254 mm (10 inches) and about 533 mm (21 inches).

More specifically, at least one of the first and second protector components may have a width of between about 431.8 mm (17 inches) and about 457.2 mm (18 inches).

More specifically, at least one of the first and second protector components may have a width of substantially 450 mm (17.72 inches).

Alternatively or in addition, the protector apparatus may comprise a plurality of protector assemblies that are brought into engagement with each other to form the protector apparatus. Having a protector apparatus comprised of a plurality of protector assemblies provides for ease of use by a person.

More specifically, the plurality of protector assemblies may comprise first and second end protector assemblies.

More specifically, an end protector assembly of the plurality of protector assemblies may be configured to engage at only a first of two opposing ends of the end protector assembly with another protector assembly.

More specifically, a first end of the end protector assembly may be configured to interlock with an end of another protector assembly. For example, the other protector assembly may be a second end protector assembly.

More specifically, the first end of the end protector assembly may comprise one of a male portion and a female portion configured to interlock with a corresponding one of a female portion and a male portion provided on the other protector assembly.

A male portion may comprise an annular member extending from an end of a protector assembly. A female portion may comprise an annular groove formed towards an end of a protector assembly. The annular member and the annular groove may have corresponding profiles such that the annular member can be received in the annular groove. Thus, the male and female portions can interlock with each other.

Alternatively or in addition, an end protector assembly may be configured to engage with another protector assembly such that rotation of the end protector assembly and the other protector assembly in relation to each other is resisted.

More specifically, the end protector assembly and the other protector assembly may define interlocking profiles.

More specifically, one of the end protector assembly and the other protector assembly may define a radially extending recess extending part way around the protector assembly and the other of the end protector assembly and the other protector assembly may define a radially extending protrusion, the protrusion being receivable in the recess. Thus, the protrusion and recess may be disposed on the end protector assembly and the other protector assembly respectively, e.g. on the annular member, so as to resist relative rotation of the protector assemblies.

Alternatively or in addition, at least one end protector assembly may have a length along a direction of the first bore of between about 0.25 m and about 1.5 m.

More specifically, at least one end protector assembly may have a length along a direction of the first bore of between about 0.5 m and about 0.6 m.

More specifically, at least one end protector assembly may have a length along a direction of the first bore of substantially 585 mm. The at least one end protector assembly may have such a length when in use, i.e. when interlocked with another protector assembly.

Alternatively or in addition, a first bore of an end protector assembly may have a profile shaped to be a snug fit around a portion of a string (e.g. at a connection between two sections of string) of varying diameter along a portion of the string.

More specifically, a central part of the first bore of the end protector assembly may be of greater diameter than a diameter the first bore towards each end of the end protector assembly.

Alternatively or in addition, a second end of the end protector assembly, which opposes the first end of the end protector assembly, may define a chamfer.

Alternatively or in addition, the plurality of protector assemblies may comprise at least one centre protector assembly.

More specifically, the centre protector assembly may be configured to engage at a first end with a first end protector assembly and to engage at a second, opposing end with at least one of: another centre protector assembly; and a second end protector assembly.

Thus, a length of the protector apparatus may be changed by: bringing two end protector assemblies into engagement with each other to provide a short protector apparatus; or by bringing each of the two end protector assemblies into engagement with a centre protector assembly to form a longer apparatus; or by bringing each of the two end protector assemblies into engagement with a respective first and second centre protector assembly and bringing the centre protector assemblies into engagement with each other to form an even longer apparatus.

More specifically, the centre protector assembly may be configured to interlock at the first end with the end protector assembly.

Alternatively or in addition, the centre protector assembly may have a length along a direction of the first bore of between about 0.25 m and about 1.5 m.

More specifically, the centre protector assembly may have a length along a direction of the first bore of between about 0.5 m and about 0.6 m.

More specifically, the centre protector assembly may have a length along a direction of the first bore of substantially 550 mm. The centre protector assembly may have such a length when in use, i.e. when interlocked with other protector assemblies.

Alternatively or in addition, the centre protector assembly may be configured to interlock at the second end with at least one of: the other centre protector assembly; and the second end protector assembly.

More specifically, the first end of the centre protector assembly may comprise one of a male portion and a female portion configured to interlock with a corresponding one of a female portion and a male portion provided on the end protector assembly.

More specifically, the second end of the centre portion assembly may comprise the other of the male portion and the female portion.

At least one of the end portion assembly and the centre portion assembly may comprise one or more features of the protector assembly described above and below.

Alternatively or in addition, the protector assembly may comprise two handles disposed on the protector assembly such that a user may lift the protector assembly by means of the two handles.

More specifically, the two handles may be disposed on substantially opposing sides of the protector assembly, Alternatively or in addition, a handle may be removable from the protector assembly to which it is attached.

More specifically, where the protector assembly comprises first and second protector components, a first of the handles may be disposed on the first protector component and a second of the handles may be disposed on the second protector component.

Alternatively or in addition, the two handles may be disposed about half way along the protector assembly along a direction of the first bore.

Alternatively or in addition, a handle may comprise an elongate handle member, with a first end of the elongate handle member being attached to the protector assembly such that the elongate handle member extends from the protector assembly.

More specifically, the elongate handle member may be substantially cylindrical.

Alternatively or in addition, the protector apparatus may comprise at least one fastener.

More specifically, the apparatus may be configured such that the at least one fastener is operable to maintain the protector apparatus in the second disposition. More specifically, operation of the at least one fastener may allow the protector apparatus to be changed from the second disposition to the first disposition.

Alternatively or in addition, the apparatus may comprise two fasteners spaced apart from each other on the protector assembly.

More specifically, the two fasteners may be spaced apart from each other in a direction along the first bore.

Alternatively or in addition, the apparatus may comprise two pairs of fasteners, one pair of the fasteners being disposed on a first side of the first bore and the other pair of fasteners being disposed on a second, opposing side of the first bore.

More specifically, the two fasteners within each pair of fasteners may be spaced apart from each other in a direction along the first bore.

Alternatively or in addition, the fastener may comprise a first fastener member and a second fastener member, the first and second fastener members being configured to releasably engage with each other.

More specifically, the first fastener member may comprise an elongate member and a head portion, the head portion being attached to the elongate member.

More specifically, the elongate member may be attached to the protector assembly such that the elongate member is movable in relation to the protector assembly to change an effective length of the elongate member. More specifically, the elongate member may threadedly engage with the protector assembly. More specifically, the fastener may further comprise a pivoting member, which is pivotably attached to the protector assembly, and which threadedly engages with the elongate member.

More specifically, the second fastener member may comprise a profile shaped to engage with the head portion of the first member. Where the profile is formed in a plastics material, the plastics material may spread a force exerted on the profile by the head portion of the first fastener member.

Alternatively or in addition, where the protector assembly comprises first and second protector components, the first fastener member may be attached to the first protector component and the second fastener member may be comprised as part of the second protector component.

More specifically, the first fastener member may be movable, e.g. rotatable, on the first protector component. Thus, the first fastener member may be brought into engagement with the second fastener member.

More specifically, where the first fastener member comprises an elongate member and a head portion, an end of the elongate member may be rotatably attached to the first protector component.

Alternatively or in addition, the protector apparatus may comprise at least one pair of fasteners, a first fastener member of a first of the pair of fasteners may be attached to the first protector component and a first fastener member of the second of the pair of fasteners may be attached to the second protector component. Thus, the protector apparatus may be brought into use more readily, in particular where the first and second fasteners of the pair of fasteners are disposed on opposing sides of the protector apparatus. More specifically, a user may operate the first fastener to attach respective sides of the first and second protector components to each other and then operate the second fastener to attach respective opposing sides of the first and second protector components to each other.

Alternatively or in addition, each of the first and second protector components may define in part each of the first and second bores.

More specifically, each of the first and second protector components may define half of each of the first and second bores.

Alternatively or in addition, the first bore may be of substantially circular cross-section.

Alternatively or in addition, the first bore may have width (e.g. diameter) of between about 101.6 mm (4 inches) and about 304.8 (12 inches).

Alternatively or in addition, the protector assembly may be configured such that a centre of the first bore may be substantially at a same location as a centre of the protector assembly.

Alternatively or in addition, the second bore may be of substantially circular cross-section.

Alternatively or in addition, the second bore may have a width (e.g. diameter) of between about 45 mm and about 110 mm.

More specifically, the second bore may have a width (e.g. diameter) of between about 70 mm and about 80 mm.

Alternatively or in addition, at least one of the first and second bores may be of substantially a same cross-section along a length of the protector apparatus.

Alternatively or in addition, a longitudinal axis of the first bore and a longitudinal axis of the second bore may be substantially parallel to each other.

Alternatively or in addition, the protector assembly may define a third bore and the protector assembly may be configured such that the second and third bores are disposed on substantially opposing sides of the first bore. More specifically, the second and third bores may be defined by opposing faces of the first and second protector components.

More specifically, the protector assembly may define at least one further bore and the protector assembly may be configured such that the second, third and at least one further bores are spaced apart around the first bore.

Alternatively or in addition and where the protector assembly comprises first and second protector components, at least one further bore other than the first bore may be defined at a location spaced apart from opposing surfaces of the first and second protector components.

More specifically, the first protector component may comprise a protector part, the first protector component and the protector part defining the first bore between them.

More specifically, the protector part and the second protector component may define the at least one further bore between them.

Thus, the string may be received in the first bore and then in a separate action the at least one cable may be received in a respective one of the at least one further bore.

Alternatively or in addition, the first protector component and the protector part may be movable in relation to each other between a first disposition, in which the string may be received in the first bore, and a second disposition, in which removal of the string from the first bore is resisted.

More specifically, the first protector component and the protector part may comprise at least one hinge operative to provide relative rotational movement of the first protector component and the protector part between the first and second dispositions.

Alternatively or in addition, the protector apparatus may have a substantially circular footprint when viewed looking along the first bore.

Alternatively or in addition, the cable may be an umbilical.

More specifically, the plastics material may comprise a thermoplastic plastics material.

More specifically, the plastics material may comprise a thermoplastic polyamide, such as Nylon®.

Alternatively or in addition, the protector assembly may be formed at least in part of a sacrificial material. In use, a sacrificial material may be liable to wear away in preference to a material (such as metal or concrete) of a body with which the protector assembly comes into contact.

Alternatively or in addition, the plastics material may comprise a buoyancy material, which is operative to make the protector assembly positively buoyant in sea water.

More specifically, the buoyancy material may comprise particulates dispersed through at least part of the plastics material.

Alternatively or in addition, the buoyancy material may comprise glass beads.

According to a second aspect of the present invention, there is provided oil or gas exploration or recovery apparatus comprising apparatus according to the first aspect of the present invention.

More specifically, the oil or gas exploration or recovery apparatus comprises a semi-submersible rig.

Further embodiments of the second aspect of the present invention may comprise one or more features of the first aspect of the present invention.

According to a third aspect of the present invention there is provided a kit of parts for protecting at least one cable during operation of a diverter, the kit of parts comprising first and second end protector assemblies and at least one centre protector assembly, each of the end protector and centre protector assemblies being substantially formed of a plastics material and defining a plurality of bores, a first of the plurality of bores being configured to receive a string and a second of the plurality of bores being configured to receive a cable, each of the first and second end protector assemblies being configured to engage at only a first of its two opposing ends with a centre protector assembly, the at least one centre protector assembly being configured to engage at each opposing end with one of another centre protector and an end protector assembly, the kit of parts, when the end protector and centre protector assemblies are engaged with each other, defining an external surface with which an operating diverter engages.

Embodiments of the third aspect of the present invention may comprise one or more features of the first and second aspects of the present invention.

According to a fourth aspect of the present invention, there is provided a method of protecting at least one cable during operation of a diverter by using at least one protector assembly, the at least one protector assembly being substantially formed of a plastics material and defining a plurality of bores, a first of the plurality of bores being configured to receive a string and a second of the plurality of bores being configured to receive a cable, the method comprising:

receiving a string in the first bore of the protector assembly; and receiving a cable in the second bore of the protector assembly, the thus used protector assembly defining an external surface configured to engage with a diverter when the diverter operates.

Embodiments of the fourth aspect of the present invention may comprise one or more features of the first or second aspects of the present invention.

BRIEF DESCRIPTION OF THE DRAWINGS

Further features and advantages of the present invention will become apparent from the following specific description, which is given by way of example only and with reference to the accompanying drawings, in which.

SPECIFIC DESCRIPTION

Figure 1:
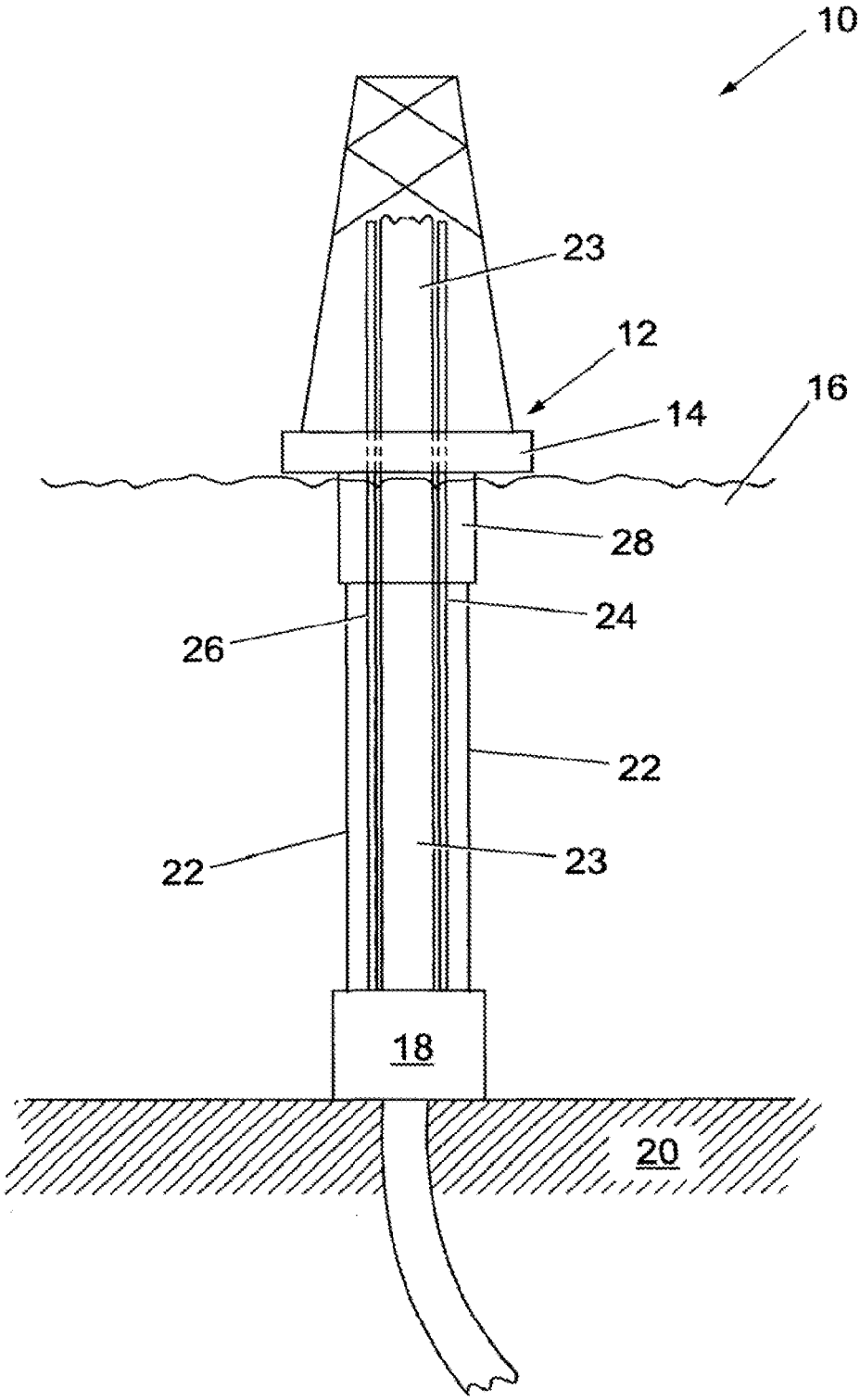
FIG. 1 shows a semi-submersible rig in use according to known practice.

FIG. 1 shows a semi-submersible rig 10 in use during an off-shore oil or gas exploration or completion procedure. The semi-submersible rig 10 comprises a rig platform 12 having a rig floor 14, which floats on the ocean surface 16, and a well-head 18 located on the sea floor 20. As will be familiar to those skilled in the art, the well-head 18 provides access below the sea floor, for example, to a reservoir of gas or oil that is undergoing exploration or completion. The rig floor 14 and the well-head 18 are connected by a slip jointed marine riser 22 within which is run a running/landing string 23 needed for the oil or gas exploration or completion procedure. The length of the slip jointed marine riser 22 changes to accommodate the rises and falls experienced by the rig floor 14 as it floats on the ocean surface 16. Communication between electrical and hydraulic equipment in the rig platform 12 and in the well-head 18 is by way of a first and a second umbilical 24, 26. A blow out diverter 28 is provided underneath the rig floor 14. As will be familiar to those skilled in the relevant art, operation of a blow out diverter 28 involves the deployment of a bag which seals around the landing/running string 23 below the rig floor 14 and the diversion of the gas and drilling fluids, which are contributing to the blow out, away from the rig floor.

Figure 2:
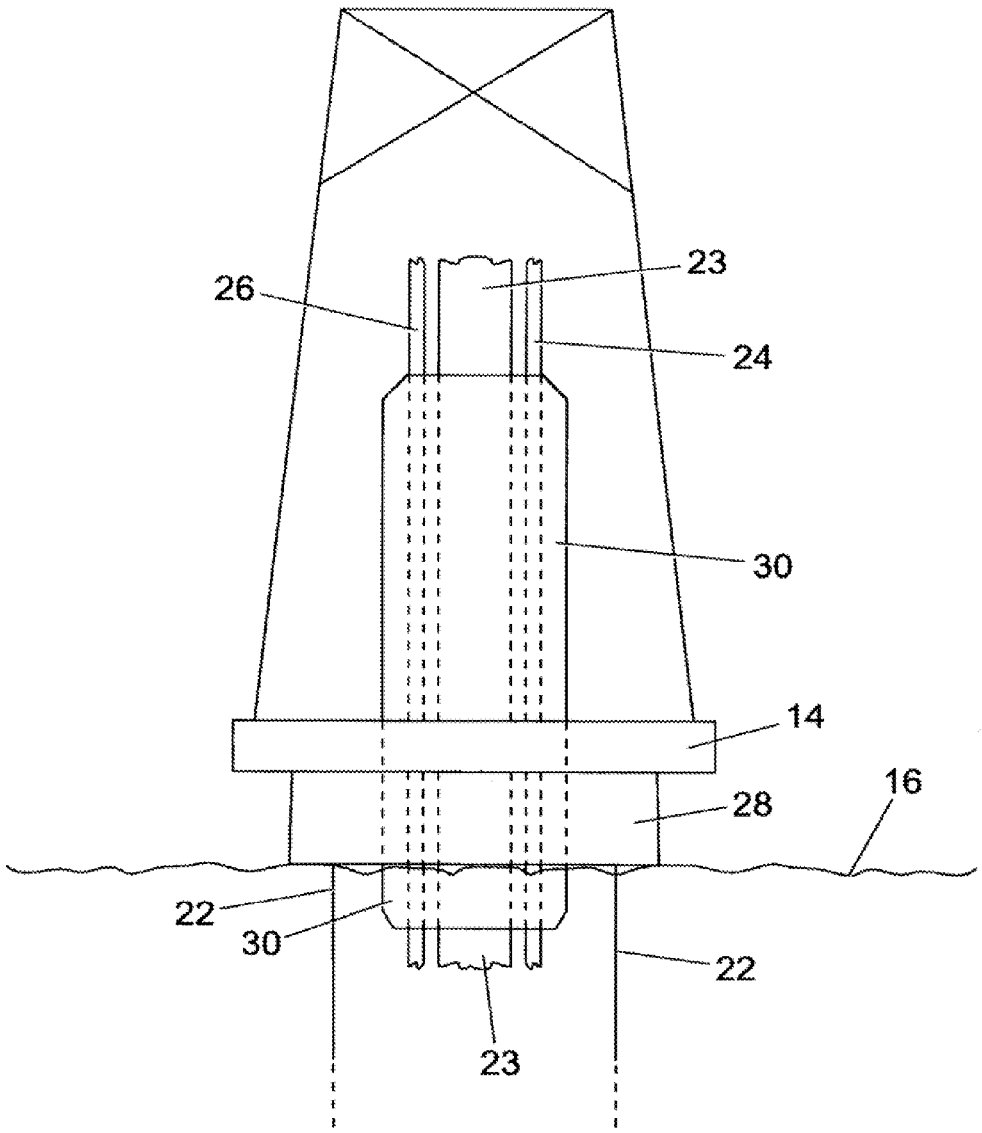
FIG. 2 shows a detailed view of a rig floor on which the present invention is used.

FIG. 2 provides a detailed view of the rig floor of the rig shown in FIG. 1, in which protector apparatus according to the present invention is shown. FIG. 2 shares many components in common with FIG. 1 and thus the reader's attention is directed to the description provided above with reference to FIG. 1 for a description of such components. In addition to the components already described with reference to FIG. 1, the rig floor arrangement of FIG. 2 comprises a protector apparatus 30. As can be seen from FIG. 2, the protector apparatus 30 fits around the landing/running string 23 and the first umbilical 24 and the second umbilical 26, such that an exterior surface of the protector apparatus is presented to the blow out diverter 28. Upon operation of the blow out diverter 28, the diverter bag (not shown) deploys towards the string 23 and engages with the exterior surface of the protector apparatus 30. Thus and compared with the arrangement shown in FIG. 1, the diverter bag no longer engages with the string 23 and the first umbilical 24 and the second umbilical 26, thereby protecting the umbilicals from damage that they might otherwise sustain upon deployment of the diverter bag. Also, the protector apparatus 30 presents a plane, curved surface against which the diverter bag can seal properly, thereby providing for improved operator safety.

Figure 3A:
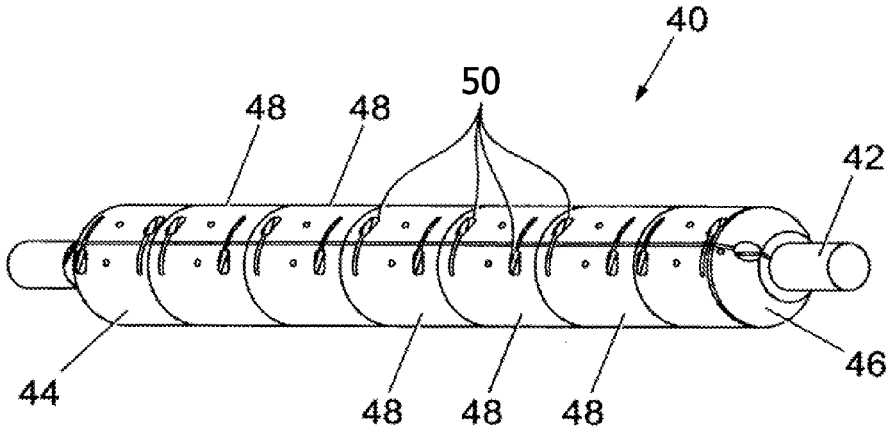
FIG. 3A is a perspective view of the present invention when assembled for use.

FIG. 3A provides a detailed view of the protector apparatus 40 when in position on a string 42. The protector apparatus 40 comprises a first end protector assembly 44 and a second end protector assembly 46, the first and second end protector assemblies being disposed at opposing ends of the protector apparatus. Five centre protector assemblies 48 are disposed around the string 42 such that they are end to end and between the first and second end protector assemblies 44, 46. Each protector assembly comprises fasteners 50 for fastening the protector assembly to the string. The fasteners 50 are described in more detail below. Each of the protector assemblies defines a first bore for receiving the string 23 and two further bores for receiving a respective one of the two umbilicals 24, 26, as will be described below in more detail.

The end and centre protector assemblies have a width (i.e. outer diameter) of substantially 450 mm (17.72 inches). Each end protector assembly has a length along a direction of the first bore, when interlocked with another protector assembly, of substantially 585 mm. Each centre protector assembly has a length along a direction of the first bore, when interlocked with other protector assemblies, of substantially 550 mm. The first bore has a width (e.g. diameter) determined in dependence on the diameter of the casing, tubing or drill pipe with which it is to be used. Thus the width of the first bore is typically selected from: 4.5 inches; 5 inches; 5.5 inches; 6 and five eighth inches; 7 inches; 8 and five eighth inches; 9 and five eighth inches; and 10.75 inches.

Figure 3B:
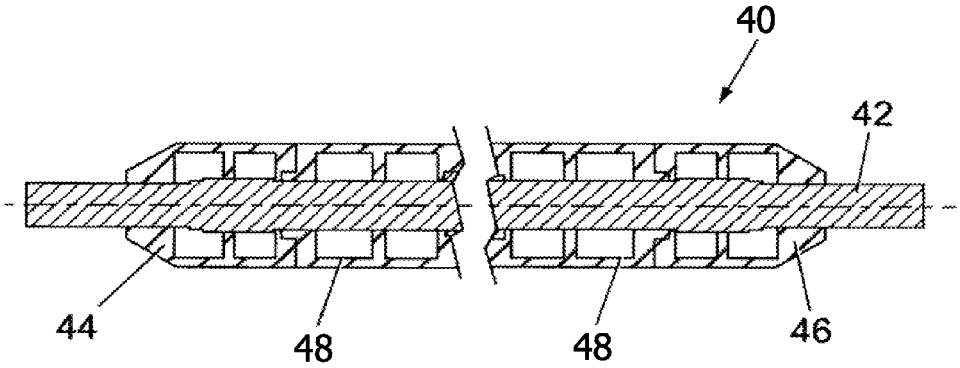
FIG. 3B is a view of a section through the present invention of FIG. 3A.

FIG. 3B provides a schematic side view of a section through the protector apparatus 40 shown in FIG. 3A, the section being taken along the string 42. FIG. 3B shows the components already described above with reference to FIG. 3A.

Figure 3C:
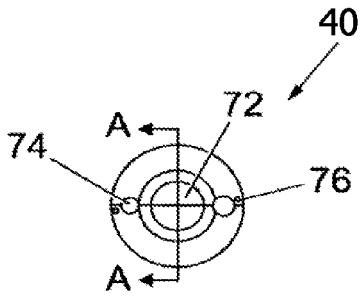
FIG. 3C is a view in cross section of the present invention of FIG. 3A.

FIG. 3C provides a schematic front view of a section through the protector apparatus 40 of FIG. 3A, the section being across the string. As can be seen from FIG. 3C, the protector apparatus 40 defines a first bore 72, in which 31 the string is received, and second and third bores 74, 76, in which a respective one of the two umbilicals 24, 26 is received. Each of the first and second bores is of a diameter of 70 mm to 80 mm with the diameter depending on the diameter of the umbilical.

Figure 4:
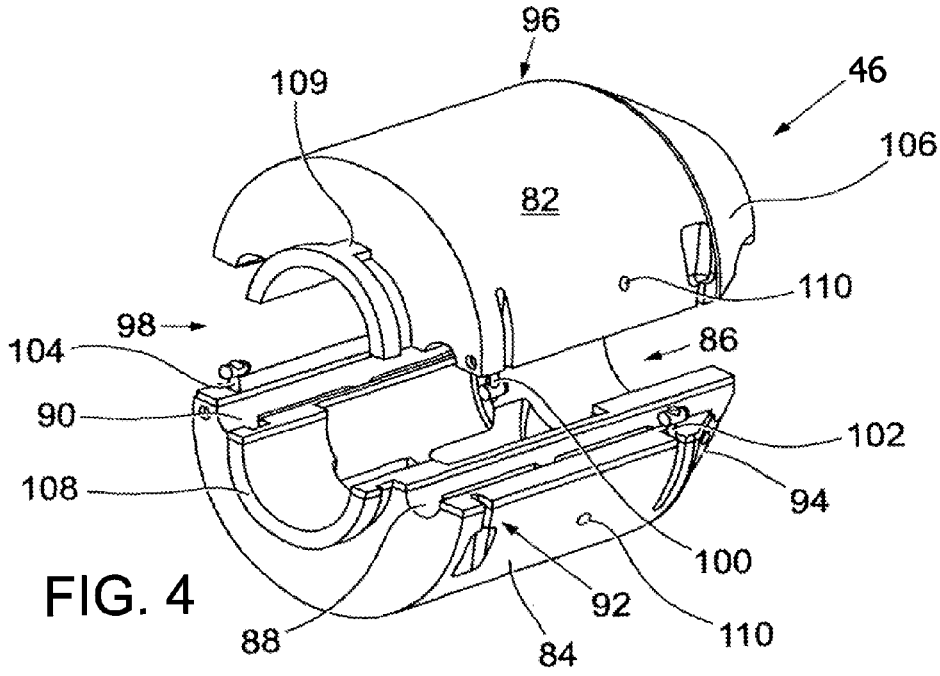
FIG. 4 is a perspective view of an end protector assembly.

A detailed perspective exploded view of the second end protector assembly 46 is shown in FIG. 4. More specifically, the second end protector assembly 46 comprises a first protector component 82 and a second protector component 84. The first protector component 82 and the second protector component 84 are movable bodily in relation to each other between a first disposition and a second disposition. FIG. 4 shows the first disposition in which a string can be received in the first bore 86 defined between the first and second protector components 82, 84 by moving the first and second protector components 82, 84 into position around the string. In the second disposition, which is shown in FIGS. 3A and 3B, the first and second protector components 82, 84 are adjacent such that removal of the string from the first bore 86 is resisted. FIG. 4 also shows the second and third bores 88, 90 which receive a respective umbilical when the first and second protector components 82, 84 are moved from the first disposition to the second disposition.

The first and second protector components 82, 84 are attached to each other when in the second disposition by two pairs of fasteners 92, 94, 96, 98. A first one of each pair of fasteners is disposed on a first side of the protector components 82, 84 and a second one of each pair of fasteners is disposed on a second, opposing side of the protector components 82, 84. The two pairs of fasteners are spaced apart from each other along the protector components. Each fastener comprises an elongate member, which is threadedly received in a pivot (not shown) mounted on a protector component; the pivot, which is of elongate form, is mounted for rotation on the protector component. The threaded engagement of the elongate member and the pivot provide for the effective length of the elongate member to be changed by rotating the elongate member in relation to the pivot on their corresponding threaded portions. A head portion is attached at the end of the elongate member opposing the end at which the elongate member threadedly engages with the pivot. Each fastener further comprises a profile shaped to engage with the head portion; the profile is formed in the other of the two protector components to that to which the elongate member is attached. Changing an effective length of the elongate member by rotating the elongate member in relation to the pivot determines how tightly the two protector components are fastened to each other.

The elongate member and the pivot of each fastener are formed of an appropriate metal, such as steel. The head portion is formed of a plastics material or rubber.

The four fasteners 92 to 98 are disposed on the second end protector assembly 46 as follows. An elongate member 100 of the first fastener 92 is attached to the first protector component 82. An elongate member 102 of the second fastener 94, which is on the same side of the protector assembly 46 as the first fastener, is attached to the second protector component 84. An elongate member (not shown) of the third fastener 96, which is on an opposing side of the protector assembly 46 such that it is directly opposite the second fastener, is attached to the first protector component 82. An elongate member 104 of the fourth fastener 98, which is on the same side of the protector assembly 80 as the third fastener, is attached to the second protector component 84.

As can be seen from FIG. 4, one end of the second end protector assembly 80 has a chamfer 106. The other opposing end has a male portion 108 extending from an end face of the protector assembly. The male portion 108 comprises an annular member that is formed by an annular portion extending from the first protector component 82 and an annular portion extending from the second protector component 84. A protrusion 109 is formed on the annular member.

An aperture 110 is provided half way along each side of each protector component 82, 84. Each aperture 110 is screw threaded to receive a handle (not shown) having a correspondingly screw threaded portion. Each handle is formed of a metal and is elongate in form such that it extends sufficiently from the protector component to allow for a user to lift the protector component. The handle has a rubber or plastics cover, which is shaped to provide for an improved hand grip. The handles are screwed into their respective apertures 110 when the protector components 82, 84 are being moved into position on a string 23 and removed from the string. When the protector apparatus is in use on the string the handles are removed.

Figure 5:
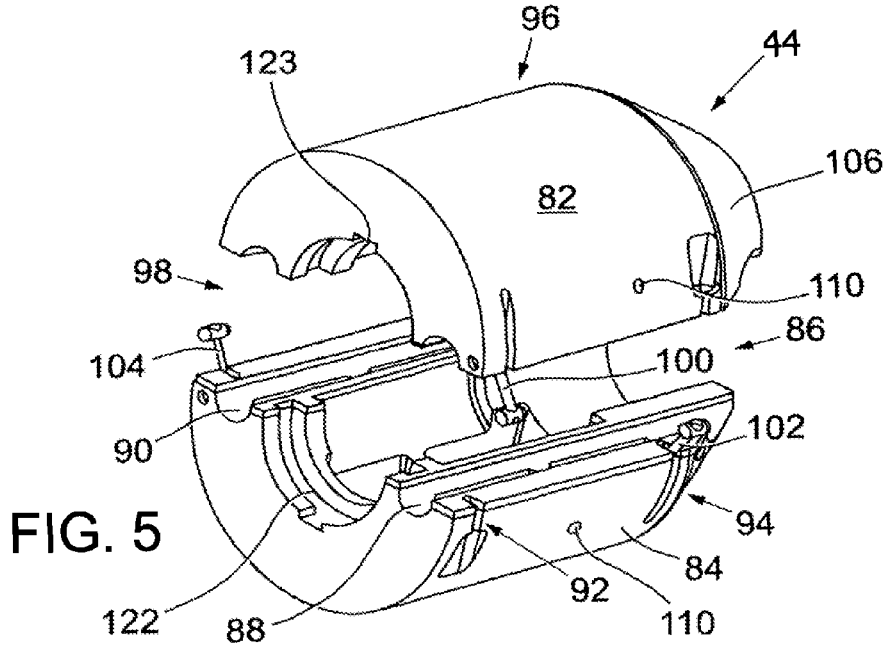
FIG. 5 is a perspective view of another end protector assembly.

A detailed view of the first end protector assembly 44 is shown in FIG. 5. The form and function of the first and second protector assemblies are the same, except as described below. Accordingly, the same reference numerals are used in FIG. 5 as in FIG. 4 and the reader's attention is directed to the description given above with reference to FIG. 4.

Turning now to FIG. 5, an end of the first end protector assembly 44 comprises a female portion 122 instead of the male portion 108 of the second end protection assembly of FIG. 4. More specifically, the female portion 122 comprises an annular groove located towards the end of the first end protector assembly 120. The annular groove is formed of groove portions formed in each of the first and second protector components 82, 84. The annular groove of the female portion 122 has a profile configured to interlock with the male portion 108 of the second end protector assembly 46. The female portion also comprises a recess 123, which in use interlocks with the protrusion 109 provided on the second end protector assembly 46 shown in FIG. 4 so as to resist relative rotation of the two protector assemblies 80, 120.

Figure 6:
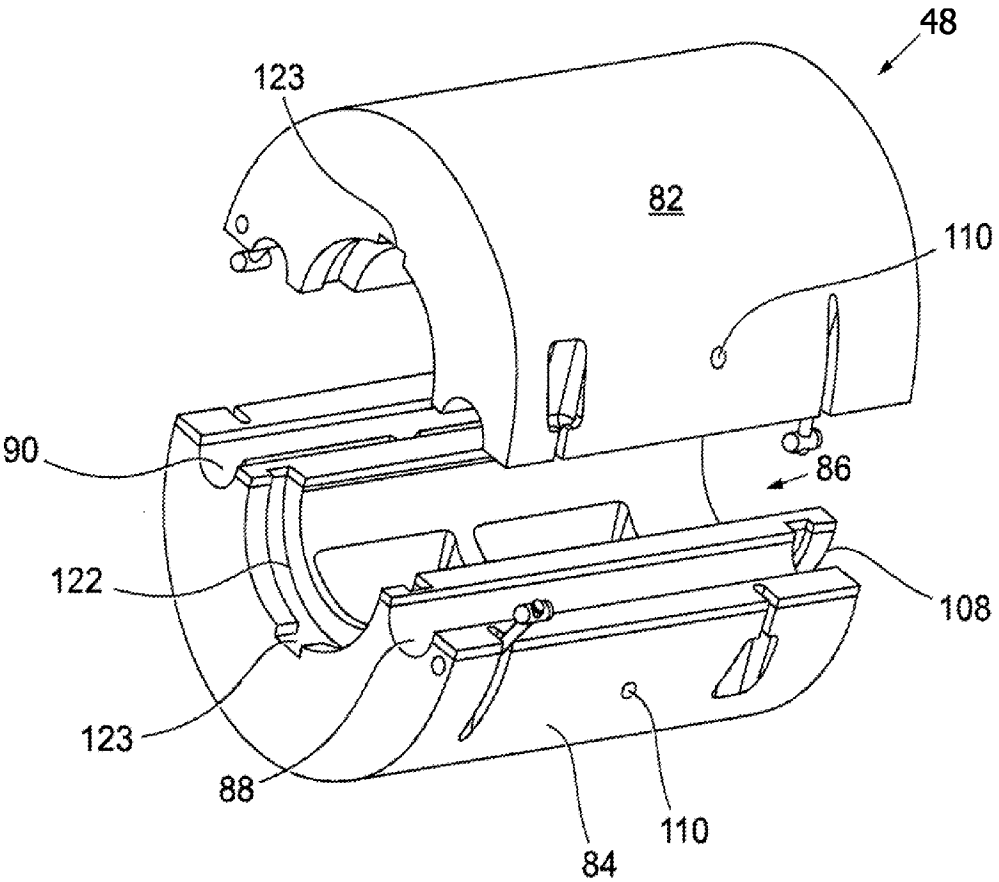
FIG. 6 is a perspective view of a centre protector assembly.

FIG. 6 provides a perspective view of a centre protector assembly 48. The form and function of the centre protector assembly 48 is the same as the first and second protector assemblies, except as described below. Accordingly, the same reference numerals are used in FIG. 6 as in FIGS. 4 and 5, and the reader's attention is directed to the description given above with reference to FIGS. 4 and 5.

Turning now to FIG. 6, the centre protector assembly 48 lacks the chamfer of the end protector assemblies. Instead the centre protector assembly 48 has a male portion 108 at one end and a female portion 122 at an opposing end. The male and female portions 108, 122 of the centre protector assembly 48 are the same as the male and female portions described above with reference to FIGS. 4 and 5. The female portion 122 has a pair of recesses 123 on opposing sides of the bore. The male portion 108 has a pair of protrusions (not shown) on opposing sides of the bore. In use, one of the protrusions and recesses of one centre protector assembly 48 interlocks with the other of the protrusions and recesses of another centre protector assembly 48 to resist relative rotation of the centre protector assemblies.

The first and second protector components 82, 84 of each of the first, second and centre protector assemblies 44, 46, 48 are formed of nylon, a thermoplastic polyamide.

In use, the first and second end protector assemblies 44, 46 are interlocked with each other using their corresponding male and female portions to form a short protector apparatus. Alternatively, one centre protector assembly 48 is interlocked with each of first and second end protector assemblies 44, 46 to form a longer protector apparatus. Alternatively and as shown in FIGS. 3A and 3B, more than one centre protector assembly 48 can be interlocked to form an even longer protector apparatus. Therefore, in an embodiment the present invention has the form of a kit of parts, which is assembled as described to form a protector apparatus of one of a number of different lengths.

Figure 7:
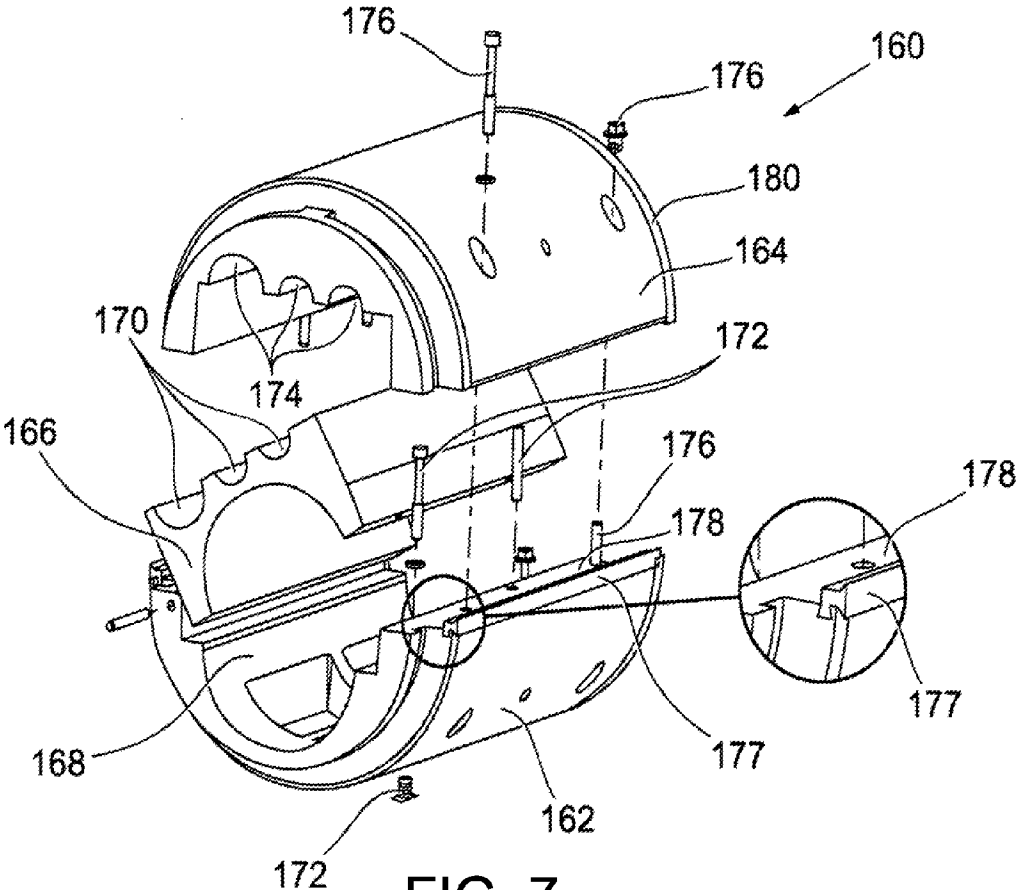
FIG. 7 is a perspective view of an alternative embodiment of centre protector assembly.

FIG. 7 provides a perspective view of an alternative embodiment of centre protector assembly 160. The form and function of the centre protector assembly of FIG. 7 is the same as the centre protector assembly described with reference to FIG. 6, except as described below. The centre protector assembly of FIG. 7 comprises first and second protector components 162, 164. The first protector component 162 comprises a protector part 166, which is attached by a hinge to the first protector component. The first protector component 162 and the protector part 166 define the first bore 168 between them when the first protector component 162 and the protector part 166 are brought together; in use, the first bore 168 receives the string. A surface of the protector part defines a plurality of recesses 170. The surface of the component part defining the plurality of recesses 170 faces in a direction opposite to the surface that defines part of the first bore 168. The first protector component 162 and the protector part 166 are held together in a second disposition in which removal of the string from the first bore 168 is prevented by means of two spaced apart pairs of nuts and bolts 172. An inside surface of the second protector component 164 defines a plurality of recesses 174. When the first and second protector components 162, 164 are brought together, as described above, and when the first protector component 162 and the protector part 166 have been brought together, the respective ones of the plurality of recesses 170, 174 defined by the protector part 166 and the second protector component 164 define a plurality of bores, each bore for receiving a respective one of a plurality of cables.

In the alternative embodiment of FIG. 7, the first and second protector components 162, 164 are held together by means of pairs of spaced apart nuts and bolts 176. The pairs of spaced apart nuts and bolts 176 are an alternative fastening mechanism to the fasteners 92, 94, 96, 98 of the protector assemblies of FIGS. 4 to 6. Thus, the pairs of spaced apart nuts and bolts 176 can be used instead of the fasteners in the embodiments of FIGS. 4 to 6. A first seal 177 is provided at an edge of one 178 of the abutting faces of the first and second protector components 162, 164. The first seal 177 is formed of a suitable resilient sealing material, such as nitrile rubber. The first seal 177 provides an effective seal between the first and second protector components 162, 164; this helps provide an effective seal between an operating diverter and the protector assembly. Each edge of the opposing faces of the first and second protector components 162, 164 has a chamfer. In addition, the seal 177 is shaped to abut against the faces of each chamfer. Thus, pressure exerted on the seal 177 from outside the centre protector assembly, e.g. pressure exerted by an operating diverter, causes the seal to be energised. A second seal 180 formed of the same material as the first seal 177 is provided towards an edge of a face at one end of the centre protector assembly 160. The second seal 180 helps provide an effective seal between the centre protector assembly 160 and another protector assembly, such as another centre protector assembly or an end protector assembly. The first and second seals 177, 180 can be used with the embodiments of the protector assembly shown in FIGS. 4 to 6.

The invention claimed is:

1. Protector apparatus for protecting at least one cable during operation of a diverter, the protector apparatus comprising:

a plurality of protector assemblies substantially formed of a plastics material, each protector assembly defining a plurality of bores, a first of the plurality of bores being configured to receive a string and a second of the plurality of bores being configured to receive a cable, each protector assembly being further configured to define an external surface with which an operating diverter can sealingly engage when the protector apparatus is in use and the string is received in the first bore, the plurality of protector assemblies being configured to be brought into engagement with each other along a direction of the first bore to form the protector apparatus, and wherein the plurality of protector assemblies comprise first and second end protector assemblies, the end protector assembly being configured to interlock at only a first of two opposing ends of the end protector assembly with another protector assembly, wherein the first end of the end protector assembly comprises one of a male portion and a female portion, configured to interlock with a corresponding one of a female portion and a male portion provided on the other protector assembly, in which the male portion comprises an annular member extending from an end of a protector assembly and the female portion comprises an annular groove formed towards an end of a protector assembly, the annular member and the annular groove have corresponding profiles such that the annular member can be received in the annular groove; and wherein the plurality of protector assemblies comprise at least one centre protector assembly, the at least one centre protector assembly being configured to engage at a first end with the first end protector assembly and to engage at a second, opposing end with at least one of another centre protector assembly and the second end protector assembly.

2. Apparatus according to claim 1, in which the end protector assembly is configured to engage with another protector assembly by means of respective interlocking profiles such that rotation of the end protector assembly and the other protector assembly in relation to each other is resisted.

3. Apparatus according to claim 1, in which a first bore of the end protector assembly has a profile shaped to be a snug fit around a portion of a string of varying diameter.

4. Apparatus according to claim 1, in which the plurality of protector assemblies is configured to extend, when in use, above and below the diverter located at or near a rig floor.

5. Apparatus according to claim 1, in which the external surface defined by the protector assembly is curved.

6. Apparatus according to claim 1, in which each of the plurality of protector assemblies comprises a first protector component and a second protector component, which are movable between a first disposition, in which a string can be moved into the first bore, and a second disposition, in which removal of the string from the first bore is resisted, and wherein each of the plurality of protector assemblies comprises a first seal, provided at an edge of one of the abutting faces of the first and second protector component, and a second seal, provided towards an edge of a face at one end of the centre protector assembly.

7. Apparatus according to claim 6, in which each protector assembly is configured such that a cable can be moved into the second bore in the first disposition and removal of the cable from the second bore is resisted in the second disposition.

8. Apparatus according to claim 6, in which the first and second protector components are movable bodily in relation to each other.

9. Apparatus according to claim 6, in which each of the first and second protector components define in part each of the first and second bores.

10. Apparatus according to claim 6, in which at least one further bore other than the first bore is defined at a location spaced apart from opposing surfaces of the first and second protector components.

11. Apparatus according to claim 10, in which the first protector component comprises a protector part, the first protector component and the protector part defining the first bore between them.

12. Apparatus according to claim 11, in which the protector part and the second protector component define the at least one further bore between them.

13. Apparatus according to claim 11, in which the first protector component and the protector part are movable in relation to each other between the first disposition, in which the string can be received in the first bore, and the second disposition, in which removal of the string from the first bore is resisted.

14. Apparatus according to claim 1, in which the protector assembly is formed at least in part of a sacrificial plastics material.

15. Apparatus according to claim 1, in which the plastics material comprises a buoyancy material, which is operative to make the protector assembly positively buoyant in sea water.

* * * * *